United States Patent [19]

Doyel

[11] 4,167,341

[45] Sep. 11, 1979

[54] VIBRATORY ACTION CLEANING DEVICE

[76] Inventor: John S. Doyel, 404 W. 20th St., New York, N.Y. 10011

[21] Appl. No.: 949,123

[22] Filed: Oct. 6, 1978

[51] Int. Cl.[2] ..... B01F 11/00

[52] U.S. Cl. ..... 366/114; 134/118; 366/128

[58] Field of Search ..... 366/128, 120, 111, 112, 366/113, 114, 110, 108, 115, 116; 134/1, 118, 117, 184, 140

[56] References Cited

U.S. PATENT DOCUMENTS

| | | | |
|---|---|---|---|
| 3,291,458 | 12/1966 | Hamm | 134/140 |
| 3,771,772 | 11/1973 | Honda | 134/184 |
| 4,061,315 | 12/1977 | Eitzen | 366/111 |
| 4,114,194 | 9/1978 | Walter | 366/111 |

*Primary Examiner*—Robert W. Jenkins
*Attorney, Agent, or Firm*—Cooper, Dunham, Clark, Griffin & Moran

[57] ABSTRACT

A device for cleaning articles such as jewelry by vibrating a container for a cleaning solution in which the articles are immersed at sonic frequencies with a motor which drives an eccentric weight. The cleaning device is made mainly of molded plastic parts which can be assembled with minimal need for tools so as to minimize manufacturing and assembly costs.

5 Claims, 3 Drawing Figures

Fig. 1.
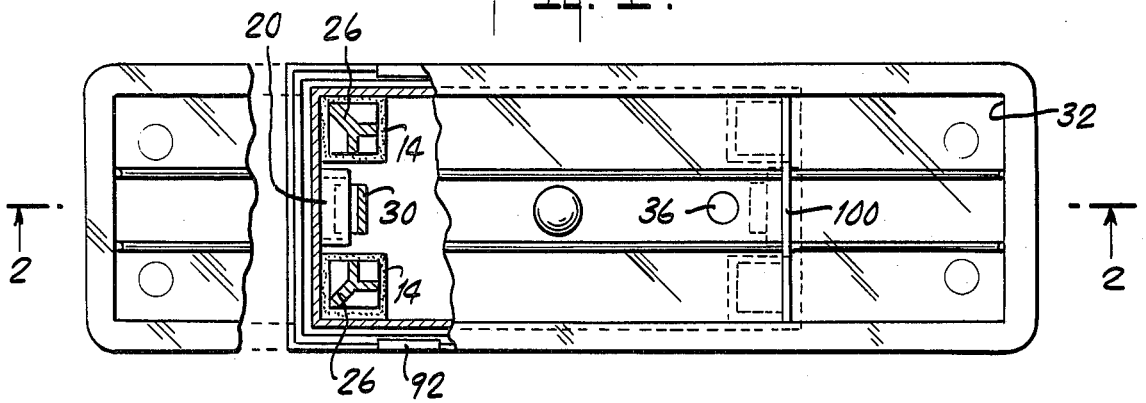
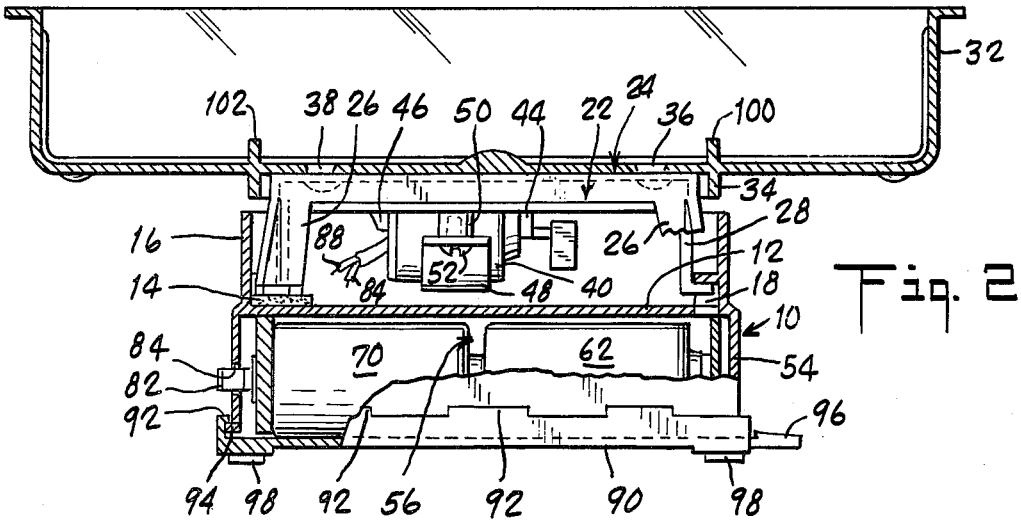
Fig. 2.
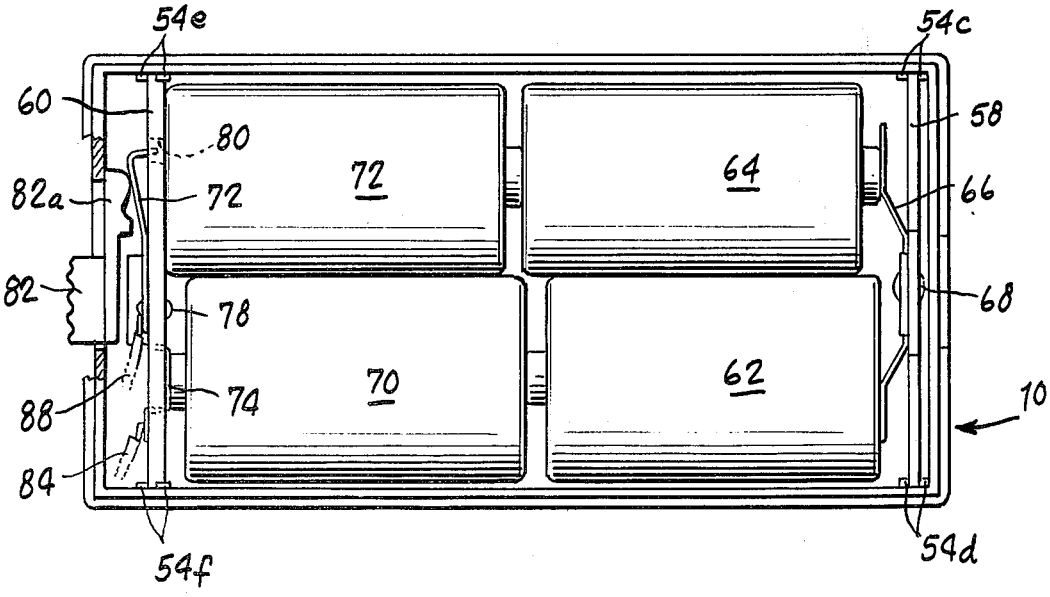
Fig. 3.

VIBRATORY ACTION CLEANING DEVICE

BACKGROUND AND SUMMARY OF THE INVENTION

The invention is in the field of devices which help clean articles such as jewelry, coins, flatware, etc. immersed in cleaning agent by sonic frequency vibration. Devices of this type are shown for example in U.S. Pat. Nos. 3,291,458 and 4,061,315. More specifically, the invention is directed to a device of this general type which is particularly inexpensive to make and easy to assemble and use. To this end the device embodying the invention is made mainly of molded plastic parts which are assembled with minimal use of tools.

The specific embodiment of the invention described in detail below comprises a housing which has a top platform with resilient pads on it and a peripheral flange which extends up from the platform. A four-legged table fits loosely within the flange and rests on the resilient pads. The table has depending resilient tabs which snap-fit loosely into and interlock with suitable recesses in the platform flange. The table fits such that it can move slightly relative to the housing but cannot fall off it. An open top container for a cleaning agent has a depending flange which fits around the top of the table and may additionally be affixed to the table so as to be kept from sliding off the table due to vibration. An electric motor affixed to the underside of the table has an eccentrically weighted shaft so as to vibrate the table when turned ON. The motor is energized by batteries in the housing and is turned ON through a switch which is particularly inexpensive to manufacture and assemble. The interaction between the various parts of the device provides for effective cleaning action despite the unusual arrangement of components.

BRIEF DESCRIPTION OF THE DRAWINGS

FIG. 1 is a top plan view, partly broken away, of a cleaning device embodying the invention.

FIG. 2 is a partly sectional view taken along line 2—2, and partly side elevational view of the device.

FIG. 3 is a bottom plan view of the device, with a base slide cover removed, with a partial section to show a switch slide.

DETAILED DESCRIPTION

The device includes a housing generally indicated by 10 which has a rectangular top platform 12 having a resilient pad 14 secured, as by an adhesive, to each of its corners. The housing also has a peripheral flange 16 which extends up from the platform and has, at two facing inner sides, recesses 18 and 20. A table generally indicated at 22 has a rectangular top 24 and a leg 26 depending from each of the table top corners to fit loosely within the peripheral flange 16 of the housing 10 and to rest on a respective resilient pad 14. The table 22 also has resilient tabs 28 and 30 which also depend from the table top 24 but do not rest on the top platform 12 of the housing 10. Instead the resilient tabs 28 and 38 are suitably angled outwardly at their free ends to interlock loosely with the recesses 18 and 20 respectively such that the table 22 can have limited movement relative to the housing 10 but cannot separate from it in normal use of the device. An open-top container 32 rests on and is secured to the table 22. The means for securing the container 32 to the table 22 include a flange 34 which depends from the bottom of the container and surrounds the table top so as to prevent the container from sliding off the table even if the table and container are not otherwise affixed to each other, and may include rivets 36 and 38 which may be formed by molding the container 32 with studs which extend downwardly from its bottom and go through suitable openings in the table top 24 and are formed with locking heads as by using a heat gun from below the table top 24. An electric motor 40 which has an eccentrically weighted shaft 42 is affixed to the underside of the table 22, as by brackets 44 and 46 which are molded together with the table 22 and extend downwardly form its bottom so as to provide a cradle for the motor 40 and a curved plastic strip 48 cradling the motor 40 from below and affixed to suitable studs molded together with the table by suitable screws. While the studs and screws flank the motor, only the front stud 50 and screw 52 are visible in FIG. 2. The housing 10 also includes a peripheral flange 54 depending below the top platform 12 which helps form a rectangular compartment for four batteries such as the common D cell batteries. More specifically, a battery compartment 56 is defined between the front and back wall **54*a* and 54*b* of the flange 54 and a first contact mounting plate 58 and a second contact mounting plate 60. The first contact mounting plate fits into the housing 10 by sliding into the space defined by the peripheral flange 54 from below into raceways 54*c* and 54*d* integrally molded with the housing 10, and the second contact mounting plate 60 similarly slides into raceways 54*e* and 54*f* which are similarly integrally molded with the housing 10. A first and a second battery 62 and 64 are side by side and are electrically connected in series by a first resilient metal contact plate 66 mounted on the mounting plate 58 as by a rivet 68. A third battery 70 is placed end to end with the first battery 62 and is in series electrical contact with it. A fourth battery 72 is placed side by side with the third battery 70 and end to end with the second battery 64 and in series electrical contact with the second battery 64. The third battery 70 makes electrical contact with a second contact plate 74 mounted on the contact mounting plate 60. A leaf spring contact 76 has one end affixed to the mounting plate 60, as by a rivet and has a free end angled to fit in a hole 80 through the mounting plate 60 which faces one contact of the fourth battery 72. The leaf spring contact 76 is biased such that its free end tends to be out of electrical contact with the fourth battery 72. A switch slide generally indicated at 82 is mounted for movement in a slot 84 in the flange 54 between the open position shown in FIG. 3 and a closed position, not shown, in which it is moved far enough up in the view in FIG. 3 to cause its cam 82*a* to move the free end of the leaf spring contact 76 into electrical contact with the fourth battery 72. Respective wires 84 and 88 are in electrical contact with the second contact plate 74 and the leaf spring contact 76 and lead to the motor 40. The bottom of the housing compartment is closed by a base slide cover 90 which has, on three of its sides, interlock tabs 92 which fit over a lip 94 extending around the bottom periphery of the housing 10. The fourth side of the base slide cover does not have interlock tabs 92 but has instead a release tab 96 which snaps over the bottom of the housing 10 to lock the base slide cover in place and must be bent down to permit the base slide cover to be slid to the left in the view of FIG. 2 so as to remove the base slide cover. The base slide cover 90 also has at each corner of its bottom a resilient pad 98 affixed to it as by an adhesive. The pads 98** may have adhesive at their bottom sides as well for helping secure the device to a table top or a similar working surface during the operation thereof.

The cleaning device is made primarily of inexpensively molded plastic components and is assembled with minimal use of tools. The open-top container 32 is molded integrally with its flange 34 and rivets 36 and 38, and may have, in addition, spacer ridges 100 and 102 extending partway up from its bottom so as to separate from each other articles placed in the container for cleaning. The table 22, with its legs 26 and resilient tabs 28 and 30 and brackets 44 and 46 and studs 50 for supporting the motor, is also integrally molded from a plastic material. Similarly, the housing 10, with its recesses 18 and 20, top platform 12, flanges 16 and 54, raceways **54*c* through 54*f* and lip 94, is integrally molded from plastic material. Of course a suitable opening is provided in the molding process for the wires 84 and 88 to run from the battery compartment to the motor. The contact mounting plates 58 and 60 and the switch slide 82 are also molded from a plastic material. The first contact plate 66 is a metal strip affixed to the mounting plates by a simple rivet. The second contact plate 74 is affixed to the mounting plate 60 by snapping it into suitable openings therein, without the need for any rivets or other fasteners. Similarly the leaf spring contact 76, while it may be secured to the mounting plate 60 by a rivet 78 as described above, may in the alternative be mounted on the mounting plate 60 by sliding its fixed end downwardly in the view of FIG. 3 into a suitable opening molded integrally with the plate 60 and placing its bent free end into the opening 80 so as to prevent the leaf spring contact 76 from thereafter being accidentally removed from the mounting plate 60**.

The assembly of the device is done with minimal use of tools. The only operations which require the use of some tools are the flattening of the undersides of studs depending from the container 32 into the rivets 36 and 38, the use of a screwdriver to secure the screws 52 to the studs 50, the use of a riveting tool to rivet the first contact plate 66 to the first mounting plate 58 and the spot welding of wires 84 and 88 to the contact plate 74 and the leaf spring contact 76 and the connection of the other ends of the same wires to the motor 40. The motor 40 with its eccentrically weighted shaft is of course a separate item. The rest of the assembly may be by hand, except perhaps for a simple tool such as a screwdriver to bend one of the resilient tabs 28 and 30 so that it would fit within its respective recess 18 or 20.

In use the articles to be cleaned are placed in a cleaning agent such as a mild detergent solution in the open-top container 32, preferably out of rubbing contact with each other, such as by separating them by the spacers 100 and 102 or by suspending articles such as rings into the cleaning agent by a ring holder (not shown) resting on the top of the container 32 and having hooks depending from it. The switch slide 82 is moved to its closed position to force the leaf spring contact 76 into electrical contact with the fourth battery 72 so as to energize the motor 40. The resulting rotation of the eccentrically weighted shaft 42 vibrates the table 22, to which the motor is affixed, and this vibration is transmitted to the cleaning agent in the container 32 through the mechanical coupling between the container and the table. The resilient pads 14, which can be made of a material such as foam rubber, serve as dampers to reduce the amount of vibration transmitted to the housing 10, and the resilient pads 98, which can be made of a similar material, serve as further dampers to further reduce the amount of vibration, if any, transmitted to the surface on which the device rests. Note that the container 32 is suitably shaped and is of sufficient size to receive for cleaning flatware such as knives, forks, etc. Note also that the batteries 62, 64, 70 and 72, which are by far the heaviest part of the device, are at its lowermost part, so as to help stabilize and damp the device against tipping and against transmitting excessive vibration to the surface supporting the device.

I claim:

1. A vibratory action cleaning device comprising:

a housing having a top platform with resilient pads thereon and a peripheral flange which extends up from the platform and has recesses at its inner side;

a table which has a top and legs depending from the top and fitting loosely within said flange of the platform and resting on said resilient pads and further has resilient tabs which snap-fit loosely into said recesses of the flange to interlock therewith, said table being capable of limited movement relative to the housing but being prevented from separating from the housing by the fit of the table legs within the flange and the interlock between the table tabs and the flange recesses;

an open-top container for a cleaning agent into which articles to be cleaned can be immersed located on the table and means for securing the container to the table to keep the container from sliding off the table despite vibratory movement of the table;

an electric motor affixed to the underside of the table top and having an eccentrially weighted shaft and means for selectively energizing the motor to drive the shaft into rotation to thereby vibrate the motor and the table to which it is affixed, said vibration in turn causing vibration of the container supported by the table and agitation of any cleaning agent and articles to be cleaned that may be in the container.

2. A cleaning device as in claim 1 in which the housing includes a hollow battery compartment under said platform and said device includes a base slide cover closing the underside of the battery compartment, said housing and base slide cover having means interlocking with each other for sliding the cover into an interlocked fit with the housing.

3. A cleaning device as in claim 1 or claim 2 in which the means for selectively energizing the motor comprise batteries located in said battery compartment and switch means secured to the housing for selectively establishing an electrical connection, between the batteries and the motor, said switch means including a leaf spring contact having a free end and a fixed end and a switch slide mounted for sliding movement on the housing between a closed position in which it forces the free end of the leaf spring into electrical contact with one pole of the batteries and the batteries are electrically connected to the motor to energize it and an open position in which the free end of the leaf spring is out of electrical contact with said one pole of the batteries and the batteries are out of electrical contact with the motor.

4. A cleaning device as in claim 3 in which the housing includes a mounting plate and means for slidably receiving the mounting plate in a position in the housing in which the mounting plate defines a boundary of the battery compartment and said switch means include a first contact plate mounted on the housing to extend into the side of the battery compartment opposite the mounting plate to provide a permanent series connection between a first and a second battery placed in the battery compartment side by side but oppositely oriented, a second contact plate on the mounting plate to provide a permanent contact to one side of a third battery which is placed in the battery compartment end to end with the first battery and is in series electrical contact therewith and wherein said leaf spring is also on said mounting plate to provide electrical contact, when said switch slide is in its closed position, with one end of a fourth battery placed in the battery compartment end to end with the second battery and in series electrical contact therewith and side by side with the third battery, and respective wires electrically connecting the second contact plate and the leaf spring to the electric motor.

5. A cleaning device as in claim 1 in which the means for securing the container to the table include a flange depending from the container and fitting around the table top.

* * * * *